US005699435A

United States Patent [19]

Killion

[11] Patent Number: 5,699,435

[45] Date of Patent: Dec. 16, 1997

[54] MICROPHONE PROBE TUBING

[75] Inventor: Mead Killion, Elk Grove Village, Ill.

[73] Assignee: Etymotic Research, Inc., Elk Grove Village, Ill.

[21] Appl. No.: 407,317

[22] Filed: Mar. 20, 1995

[51] Int. Cl.[6] ..... H04R 29/00

[52] U.S. Cl. ..... 381/60; 73/585

[58] Field of Search ..... 381/60, 58, 56; 181/130, 135, 129, 132; 73/585; 128/746

[56] References Cited

U.S. PATENT DOCUMENTS 4,122,841 10/1978 Rock et al. ..... 128/864
4,412,096 10/1983 Edgerton et al. ..... 381/60
4,827,525 5/1989 Hotvet et al. ..... 73/585
5,201,007 4/1993 Ward et al. ..... 181/135
5,440,082 8/1995 Claes ..... 181/135

*Primary Examiner*—Curtis Kuntz
*Assistant Examiner*—Vivian Chang
*Attorney, Agent, or Firm*—McAndrews, Held & Malloy, Ltd.

[57] ABSTRACT

A probe tube for use with an occluding object to test sound pressure levels within the ear canal is set forth. The probe tube has a flexible body portion having an elongated cross section. The elongated cross-section has a generally arcuate first side that contacts the wall of the ear canal and a generally arcuate second side that generally conforms to a surface of the occluding object. The flexible body portion also includes an aperture for conducting sound through the probe tube. The aperture extends along at least a portion of the length of the flexible body.

18 Claims, 3 Drawing Sheets

MICROPHONE PROBE TUBING

TECHNICAL FIELD

The present invention relates to an apparatus for use in making ear measurements. More particularly, the present invention relates to a microphone probe tubing having an elongated cross-section which, when used with an object that occludes the ear canal, minimizes undesired sound leakage from within the ear canal.

BACKGROUND

In certain tests to measure real ear insertion gain, occlusion effect, earmold quality, and other audio tests of the ear and hearing aids, a probe microphone is used. The probe microphone is a microphone with a length of tubing connected thereto.

One such microphone probe is illustrated at 10 in FIG. 1A. As illustrated, the microphone probe 10 includes a microphone 15 and a probe tube 20. The probe tube 20 is formed from a length of flexible material and, as shown in FIG. 1B, has a round cross-section of, for example, 1.0 mm. A centrally disposed aperture 25 provides a passage for sound conduction along the length of the probe tube.

Use of the probe tube 20 is illustrated in FIGS. 1C and 1D. In use, the probe tube 20 is placed into the ear a few millimeters from the tympanic membrane 30 to measure the sound pressure level in the ear canal. Sound within the ear canal is detected by the microphone 15. The tube 20 extends from the ear canal to the outer ear along an occluding object 35, such as a hearing aid earmold. As shown in FIG. 1D, the probe tube 20 is disposed between the ear canal wall 40 and the occluding object 35. The rounded cross-section of the probe tube 20 results in a distension of the ear canal wall 40 in the area of the probe tube 20. This distension creates a sound conduction area in the interstitial region between the wall 40 and the occluding object 35. The sound conduction area is generally in the form of two generally triangular leakage passageways 45 and 50, one on each side of the probe tubing 20. The leakage passageways 45 and 50 create significant measurement errors since they provide an alternate route for sound conduction between the ear canal and outer ear other than through the sound conduction aperture 25 of the probe tube 20. The measurement errors are particularly significant where the leakage due to the leakage passageways 45 and 50 are comparable to the sound transmission through aperture 25, vent 52, and areas of poor occlusion by the occluding object.

Another problem experienced in using the traditional round probe tube 20 is the problem of anchoring the tube against movement within the ear canal. A failure to properly anchor the tube 20 may result in movement of the tube from its proper placement with respect to, for example, the tympanic membrane 30. Anchoring of the probe tube 20 within the ear canal, however, is often difficult, if not impossible.

SUMMARY OF THE INVENTION

A probe tube for use with an occluding object to test sound pressure levels in the ear canal which overcomes the problems of prior probe microphones is set forth. The probe tube has a flexible body portion having an elongated cross section. The elongated cross-section has a generally arcuate first side that contacts the wall of the ear canal and a generally arcuate second side that generally conforms of a surface of the occluding object. The flexible body portion also includes an aperture for conducting sound through the probe tube. The aperture extends along at least a portion of the length of the flexible body.

In accordance with one embodiment, the probe tube is provided with means for adhering the flexible body portion of the probe tube to the occluding object. The means for adhering is disposed on the generally arcuate second side of the elongated cross-section of the flexible body. The means for adhering may be in the form of a chemical adhesive, double sided tape, etc. Additionally, a plurality of probe tubes may be disposed with the applied adhesive on a release sheet carrier.

Other objects and advantages of the present invention will become apparent upon reference to the accompanying detailed description when taken in conjunction with the following drawings.

DETAILED DESCRIPTION OF THE PREFERRED EMBODIMENT

Figure 1A:
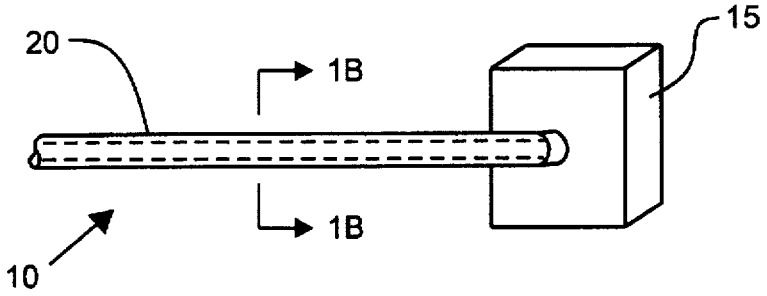
FIG. 1A (Prior Art)
FIGS. 1A–1D illustrate a probe tube of the prior art.
Figure 1B:
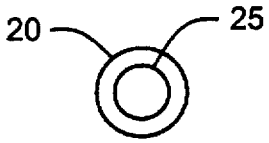
FIG. 1B (Prior Art)
Figure 1C:
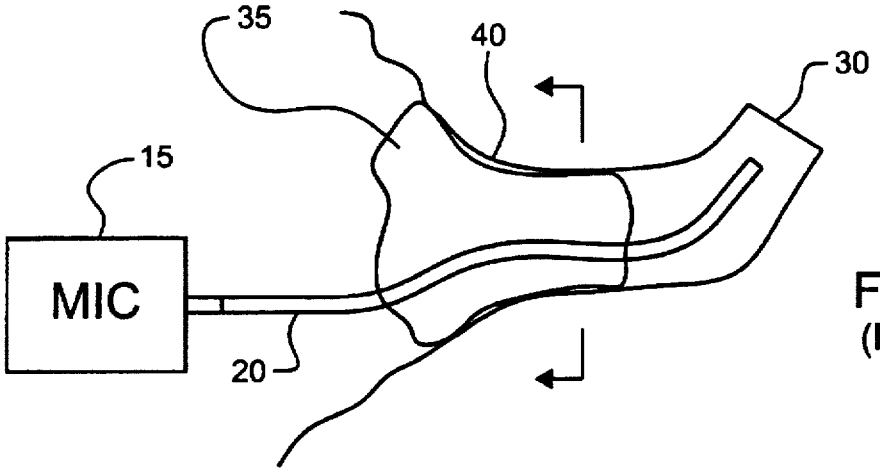
FIG. 1C (Prior Art)
Figure 2:
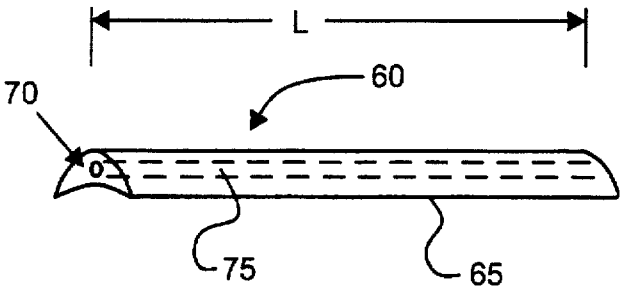
FIG. 2 is a side elevational view of a probe tube in accordance with one embodiment of the present invention.

A probe tube 60 constructed in accordance with one embodiment of the invention is illustrated in FIG. 2. As shown, the probe tube 60 includes a body portion 65 constructed from a flexible material. The body portion 65 has an elongated cross section, shown here at 70. An aperture 75 is disposed through the body portion 65 and along the length thereof. The aperture 75 functions as a sound conducting channel. The probe tube 60 preferably has a length L that is sufficient to extend from an area proximate the tympanic membrane 30 (see FIG. 1C) of the ear canal to the microphone 15 that, for example, is suspended by a supporting member proximate the patient's ear.

Figure 3:
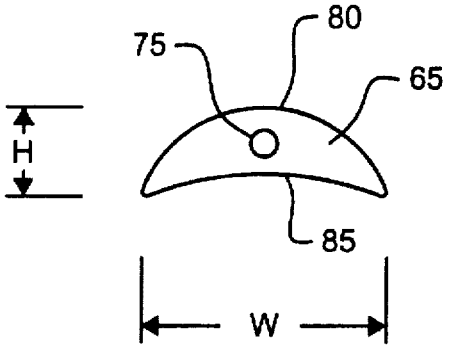
FIG. 3 is an end view of the flexible body portion of the probe tube of FIG. 2 illustrating the elongated cross section thereof.

One exemplary cross section for the probe tube 60 is shown in FIG. 3. The cross section of the probe tube 60 is elongated and includes a first generally arcuate side 80 and a second generally arcuate side 85. The aperture 75 is centrally disposed within the flexible body portion 65. In accordance with one implementation of the illustrated probe tube 60, the tube may have a height H of about 0.027 inches and a width W of approximately 0.104 inches. The aperture 75 may have a diameter of approximately 0.0197 inches. The radius of curvature of the first arcuate side 80 may be approximately 0.19 inches and the radius of curvature of the second arcuate side 85 may be approximately 0.22 inches.

Figure 4:
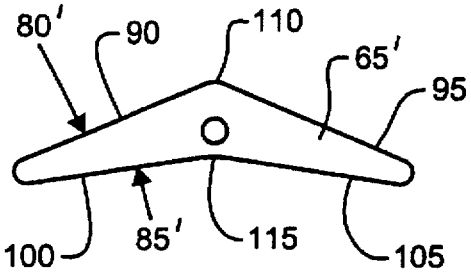
FIG. 4 is an end view of the flexible body portion of the probe tube illustrating a further shape for the elongated cross section.

A further exemplary cross section for the probe tube 60 is shown in FIG. 4. Like the embodiment of FIG. 3, the flexible body 65' includes a first generally arcuate side 80' and a second generally arcuate side 85'. The generally arcuate sides 80' and 85' of the embodiment of FIG. 4, however, are defined by generally linear sections 90, 95, and 100, 105 that are joined at rounded sections 110 and 115, respectively.

Figure 1D:
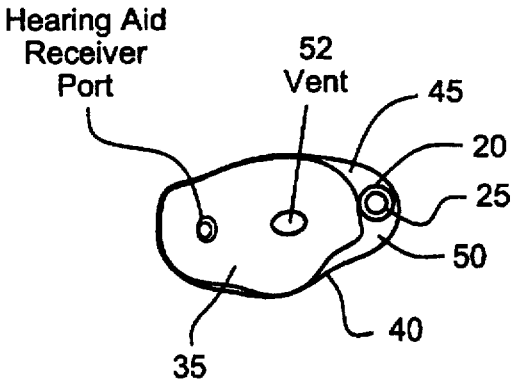
FIG. 1D (Prior Art)
Figure 5:
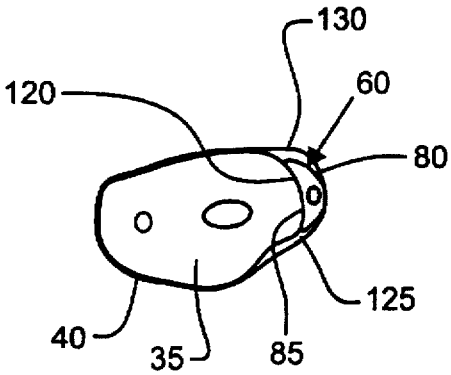
FIG. 5 is a cross-sectional view of the probe tube of FIG. 1 as inserted in the ear canal of a patient in conjunction with an occluding object.

FIG. 5 illustrates placement of the probe tube 60 within the ear canal and used in conjunction with an occluding object 35, which, for example, may be a hearing aid housing, an ear mold, an ear plug, etc. As illustrated, the second generally arcuate side 85 is disposed adjacent the occluding object 35 and generally conforms to the shape of the surface 120 of the occluding object 35. The first generally arcuate side 80 contacts and distends the wall 40 of the ear canal. The distension creates a leakage passageways 125 and 130 in the interstitial region between the wall 40 and the occluding object. The resulting leakage passageways 125 and 130, however, are significantly smaller than the leakage passageways 45 and 50 (FIG. 1D) associated with the round cross section probe tube of the prior art.

Since the acoustic flow resistance of such a leakage passageway is inversely proportional to approximately the fourth power of the height of the passage (by analogy to the flow resistance of a tube according to Poissel's law), the use of 0.5 mm tubing would be expected to increase the flow resistance by a factor of 16, compared to 1.0 mm tubing. In the case of the probe tubing 60 of the present invention, however, the leakage passageways are largely taken up with the tubing material. Each of the remaining passageways can be expected to have maximum dimensions of 0.1 to 0.2 mm so that an additional increase of some 40 times in resistance may be expected, compared to that of a 0.5 mm round probe tube or an increase of at least 640 times over the standard 1.0 mm tube. In terms familiar to hearing aid dispensers, a reduction of 50 to 60 dB (316 to 1000 times) in the leakage caused by the presence of the probe tube can be expected when the probe tube 60 of the present invention is substituted for the traditional 1.0 mm diameter round tubing. This amount is sufficient to render the problem of leakage insignificant, compared to other measurement artifacts.

Figure 6:
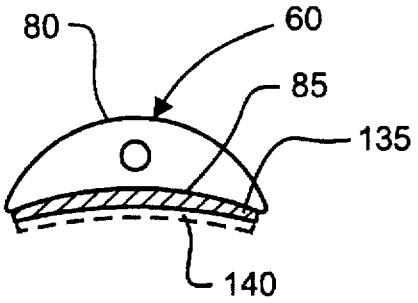
FIG. 6 is an end view of the flexible body portion of the probe tube of FIG. 2 and further including an adhesive layer disposed on the side of the body portion that contacts the occluding object.

FIG. 6 illustrates a further enhancement of the probe tube 60. In this embodiment, the second generally arcuate side 86 is provided with an adhesive layer 135 which facilitates adhesion between the probe tube 60 and the surface of the occluding object 35 to anchor the tube in proper position within the ear canal. The adhesive layer 135 may be, for example, a chemical adhesive composition such as a permanent adhesive available under the trademark DryLine™ from The Gillette Company of Boston, Mass. Other adhesive compositions are likewise suitable. Alternatively, the adhesive layer 135 may be double sided tape. The adhesive layer 135 may further be provided with a release sheet 140 which may be removed by the user from the adhesive layer 135 prior to anchoring the probe tube 60 to the occluding object 35.

Figure 7:
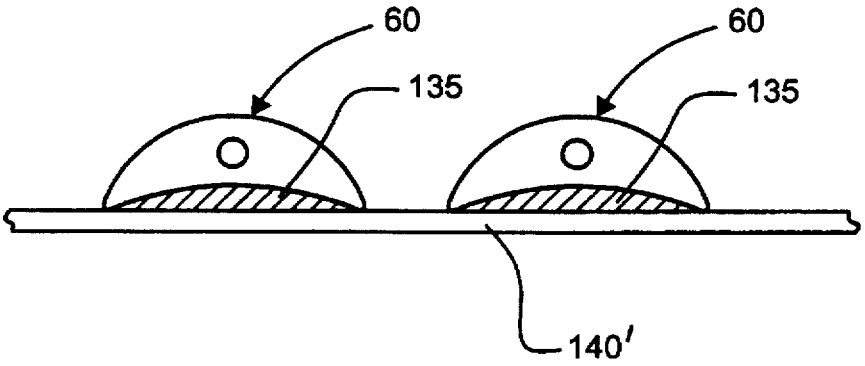
FIG. 7 is a front view of a plurality of probe tubes as applied to a single release sheet carrier.

FIG. 7 illustrates a further manner in which the probe tubes 60 may be provided to the user. As shown, a plurality of the probe tubes 60 are provided with respective adhesive layers 135 and are secured to a common carrier release sheet 140'. The user may then peel the probe tubes 60 from the sheet 140' as needed.

As will be readily recognized, the adhesive layer 135 may extend along the entire length of the tubing, but need only extend along a portion of the length. When the adhesive layer 135 only extends along a portion of the tubing length, the portions not having adhesive may extend beyond an edge of the release sheet 140, 140' thereby facilitating easy grasping of the tubing by the user for separating the tube from the release sheet.

An alternate way of ensuring adhesion between the probe tube 60 and the occluding object 35 is to form the probe tube from a tacky material such as silicon. The silicon probe tubes may likewise be provided with individual release sheets or may be provided in bulk on a common carrier release sheet.

Those skilled in the art will recognize that other elongated cross-sectional shapes for the tubing 60 may be used, the principal object of the elongated cross-section being the reduction of the size of the leakage passageways created by the tubing. Additionally, the tubing need only have the elongated cross section along a portion of its length, that portion being the portion that is disposed between the ear canal wall 40 and the occluding object 35.

Although the present invention has been described with reference to a specific embodiment, those of skill in the art will recognize that changes may be made thereto without departing from the scope and spirit of the invention as set forth in the appended claims.

I claim as my invention:

1. A probe tube for use with an occluding object that is inserted into an ear canal comprising:

a flexible body portion having an elongated cross section, the elongated cross-section having a generally convex first side for contacting ear tissue in the ear canal, and a generally concave second side for contacting and generally conforming to a surface of the occluding object, the flexible body portion having an aperture for conducting sound therethrough, the aperture extending along at least a portion of the length of the flexible body.

2. The probe tube of claim 1 and further comprising adhesive means, disposed on the generally arcuate second side, for facilitating adhesion between the flexible body portion and the occluding object.

3. The probe tube of claim 2 wherein the adhesive means comprises double sided tape.

4. The probe tube of claim 3 wherein the double sided tape comprises a first tacky side disposed on the generally (arcuate) concave second side of the flexible body portion and a second tacky side disposed on a release carrier.

5. The probe tube of claim 2 and further comprising a release sheet adjacent the adhesive means.

6. The probe tube of claim 2 wherein the adhesive means comprises a chemical adhesive compound.

7. The probe tube of claim 2 and further comprising a release sheet adjacent the chemical adhesive compound.

8. The probe tube of claim 1 wherein the flexible body portion is comprised of a material that is generally tacky.

9. The probe tube of claim 8 wherein the flexible body portion is formed from silicon.

10. A probe tube as claimed in claim 1 wherein the generally convex first side is arcuate.

11. A probe tube as claimed in claim 1 wherein the generally concave second side is arcuate.

12. A probe tube as claimed in claim 1 wherein the generally convex first side is angular.

13. A probe tube as claimed in claim 1 wherein the generally concave second side is angular.

14. An apparatus comprising:

a) a plurality of probe tubes, each probe tube being for use with an occluding object that is inserted into an ear canal, each probe tube including a flexible body portion having an elongated cross section, the elongated cross-section having a generally convex first side for generally conforming to ear tissue in the ear canal, a generally concave second side for generally conforming to a surface of the occluding object, the flexible body portion further having an aperture for conducting sound therethrough, the aperture extending along at least a portion of the length of the flexible body;

b) an adhesive disposed on the generally concave second side of the flexible body portion of each of the plurality of probe tubes; and c) a release sheet carrying the plurality of probe tubes.

15. A probe tube as claimed in claim 14 wherein the generally convex first side is arcuate.

16. A probe tube as claimed in claim 14 wherein the generally concave second side is arcuate.

17. A probe tube as claimed in claim 14 wherein the generally convex first side is angular.

18. A probe tube as claimed in claim 14 wherein the generally concave second side is angular.

* * * * *